US005885910A

United States Patent [19]

Graichen

[11] Patent Number: 5,885,910

[45] Date of Patent: Mar. 23, 1999

[54] NON-SLIP KNITTED LACE FABRIC AND METHOD OF MANUFACTURING SAME

[75] Inventor: Claus Graichen, Henderson, N.C.

[73] Assignee: Lace Lastics Company, Inc., Oxford, N.C.

[21] Appl. No.: 780,614

[22] Filed: Jan. 8, 1997

[51] Int. Cl.[6] ..... B32B 27/04

[52] U.S. Cl. ..... 442/101; 427/372.2; 427/373; 442/304; 442/306; 442/315; 442/318

[58] Field of Search ..... 427/372.2, 373; 442/101, 304, 315, 318, 306, 305

[56] References Cited

U.S. PATENT DOCUMENTS

| | | | |
|---|---|---|---|
| 60,582 | 3/1866 | Strasser . | |
| 1,743,998 | 1/1930 | Dinkelspiel . | |
| 1,847,420 | 3/1932 | Aberle . | |
| 2,088,943 | 8/1937 | Botts . | |
| 2,661,612 | 12/1953 | Crawford . | |
| 3,238,748 | 3/1966 | York et al. . | |
| 3,434,310 | 3/1969 | Perrier . | |
| 3,511,053 | 5/1970 | Blizzard . | |
| 3,517,530 | 6/1970 | Magnus . | |
| 3,530,687 | 9/1970 | Hamano . | |
| 3,572,058 | 3/1971 | Richards et al. . | |
| 3,573,964 | 4/1971 | Jones | 427/373 |
| 3,727,433 | 4/1973 | Hamano . | |
| 3,895,489 | 7/1975 | Waller . | |
| 4,010,626 | 3/1977 | Feher . | |
| 4,109,492 | 8/1978 | Roberts . | |
| 4,192,159 | 3/1980 | Kohl . | |
| 4,253,317 | 3/1981 | Howard et al. . | |
| 4,284,681 | 8/1981 | Tidmarsh et al. | 442/101 |
| 4,448,047 | 5/1984 | Ramo . | |
| 4,499,742 | 2/1985 | Burn . | |
| 4,513,589 | 4/1985 | Kearns . | |
| 4,551,995 | 11/1985 | Louison . | |
| 4,553,412 | 11/1985 | Odham . | |
| 4,732,015 | 3/1988 | Abrams et al. . | |
| 4,872,324 | 10/1989 | Rearwin et al. . | |
| 4,998,419 | 3/1991 | Moore . | |
| 5,131,099 | 7/1992 | Zellweger . | |
| 5,302,440 | 4/1994 | Davis | 442/101 |

FOREIGN PATENT DOCUMENTS

| | | |
|---|---|---|
| 2026933 | 12/1971 | Germany . |
| 1046360 | 4/1982 | Russian Federation . |

OTHER PUBLICATIONS

Knitting Shaped Panty Hose on Cocker Patternmaster, pp. 112–118.

Jacquard Design Techniques in Raschel Knitting, pp. 136–140.

Warp Knitting Technology pp. 306–307.

Excerpts from Brochure on Wells Lamont Gloves.

Various Specimens.

*Primary Examiner*—James J. Bell

*Attorney, Agent, or Firm*—Amster, Rothstein & Einstein

[57] ABSTRACT

A non-slip knitted lace fabric has opposed first and second surfaces of yarn and a stretchable tacky layer of cured and foamed, oleophobic and hydrophobic plastisol disposed at least partially on one of the first and second surfaces to provide enhanced frictional engagement of the fabric with a surface adjacent to the tacky layer. Preferably the fabric has a loop-forming yarn knitted therein so as to provide a plurality of loops of the loop-forming yarn as the one surface. The tacky layer extends through the openings of at least some of the loops. Optimally, the loop-forming yarn is elastic and tacky.

14 Claims, 11 Drawing Sheets

FIG. 6
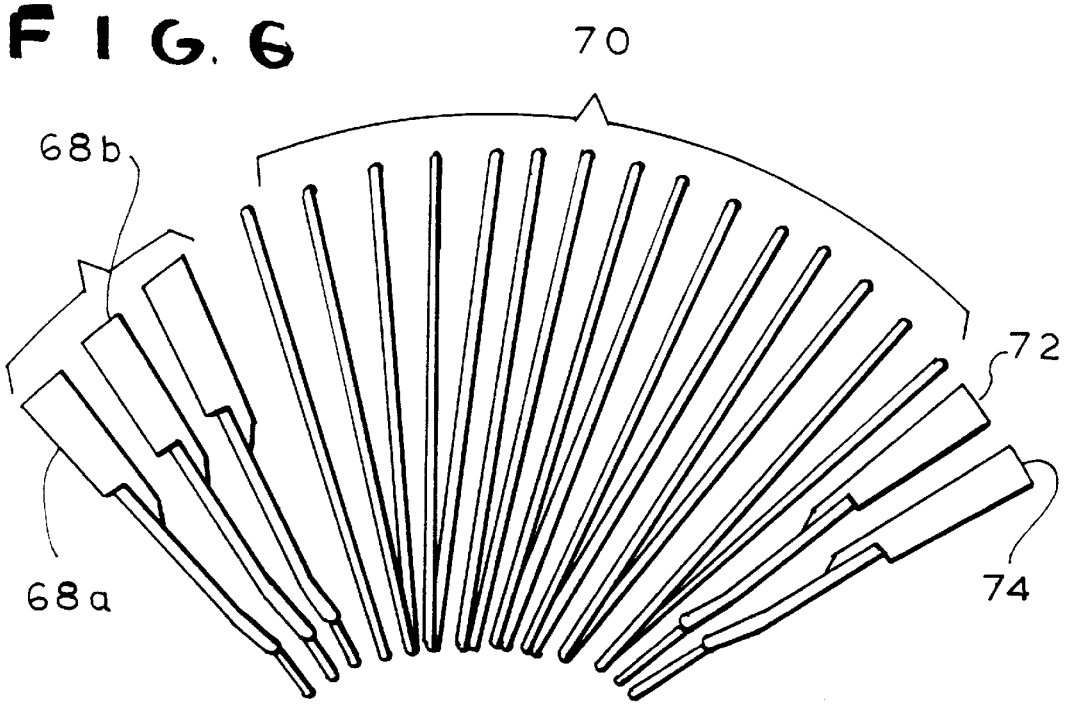
FIG. 7
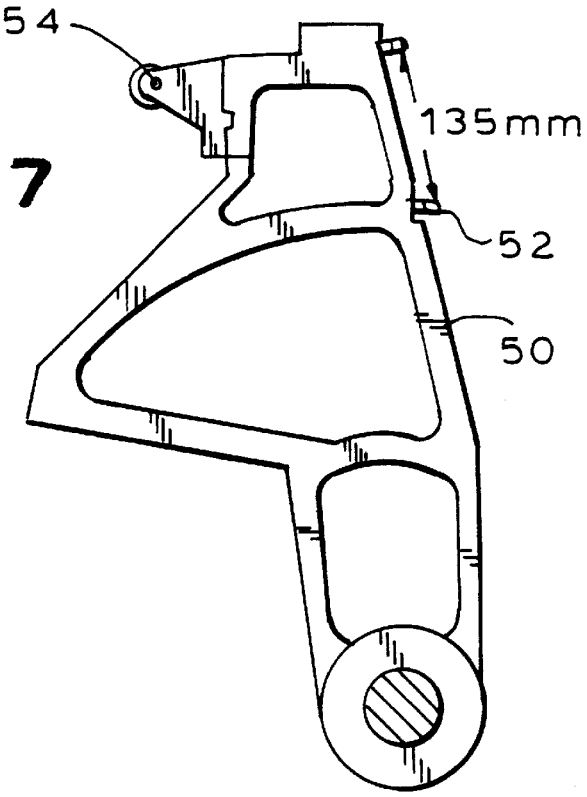
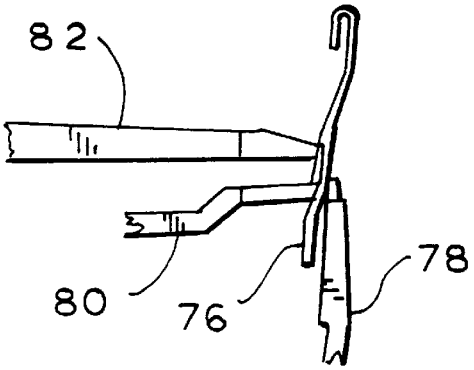
FIG. 8

NON-SLIP KNITTED LACE FABRIC AND METHOD OF MANUFACTURING SAME

BACKGROUND OF THE INVENTION

The present invention relates to a knitted lace fabric and to a method of manufacturing the same, and more particularly to such a fabric having a non-slip property making it highly suitable for the lacy tops of thigh-high stockings, the lacy bottoms of girdles, and the like.

Elastic material, such as spandex, has been knitted into lace products to provide elasticity. For example, stockings having lace borders commonly contain spandex yarns so that the lace border may stretch to accommodate various sizes and shapes of legs. The spandex yarns create a squeezing effect on the wearer's legs which hopefully keeps the stocking tops up. However, the lace border nevertheless presents a smooth surface, and the presence of the spandex may not prevent the stockings from slipping down the legs. Accordingly, garters or the like are typically used to maintain the stockings on the legs.

In an effort to eliminate the need for garters, rubber yarns have been woven or knitted against the back of a lace band fabric to provide increased friction with the wearer's skin. The rubber yarns were laid flat against the back of the fabric and tied down under full tension. This approach has been eliminated mainly because of the deterioration of the rubber over time, due to exposure to body oils and the like.

Beads of silicone are currently widely used instead of the rubber yarns. The silicone is applied in a pattern to the underside (i.e., skin side) of the finished lace product so as to frictionally engage the user's skin to hold the stocking in place. However, the silicone cannot be dyed and thus, although the silicone is applied to the underside of the lace material, it can be seen therethrough, thereby diminishing the aesthetic appearance of the stocking or other garment. Additionally, the silicone has quite limited elastic properties and tends not to completely stretch with the lace product. Thus when the lace border is periodically stretched as the stocking is put on and worn, the silicone bead may separate and/or crumble from the lace. In addition, upon washing, the silicone rubber also tends to crumble and detach from the lace material. Even further, recent concerns regarding the bio-compatibility of silicone materials and fears that the silicone may leach into the skin have raised concerns among consumers using such products.

Accordingly, it is an object of the present invention to provide a knitted lace fabric which is characterized by a high level of non-slip property—that is, a non-slip fabric.

Another object is to provide such a fabric wherein the non-slip property does not substantially fade away during the time the fabric is being worn.

A further object is to provide such a fabric which resembles ordinary knitted lace fabric not having the non-slip property.

It is also an object of the present invention to provide a method for manufacturing such a non-slip knitted lace fabric.

SUMMARY OF THE INVENTION

It has now been found that the above and related objects of the present invention are obtained in a non-slip knitted lace fabric. The non-slip knitted lace fabric has opposed first and second surfaces of yarn and a stretchable tacky layer of cured and foamed, oleophobic and hydrophobic plastisol disposed at least partially on one of the first and second surfaces to provide enhanced frictional engagement of the fabric with a surface adjacent to the tacky layer.

In a preferred embodiment, the fabric has a loop-forming yarn knitted therein so as to provide a plurality of loops thereof as the one of the first and second surfaces, the tacky layer extending through the loop openings of at least some of the loops. The loop-forming yarn is preferably elastic and/or tacky.

In another preferred embodiment, the fabric has a layer of yarn knitted therein as a net, intermediate the first and second surfaces, so as to provide a barrier to passage of the loops from the one of the first and second surfaces to the other of the first and second surfaces. The net is preferably non-tacky.

The present invention also encompasses a method of making non-slip knitted lace fabric comprising the steps of providing a knitted lace fabric having opposed first and second surfaces of yarn and applying uncured and unfoamed plastisol at least partially on one of the first and second surfaces. The layer of plastisol is then cured and foamed to provide a stretchable tacky layer of oleophobic and hydrophobic plastisol affording enhanced frictional engagement of the fabric with a surface adjacent to the tacky layer.

In a preferred embodiment, the fabric is provided with a loop-forming yarn knitted therein so as to provide a plurality of loops thereof as the one of the first and second surfaces, and the layer of plastisol is applied so as to extend through the loop openings of at least some of the loops. Preferably the fabric has an intermediate layer of yarn knitted therein as a net, intermediate the first and second surfaces, so as to provide a barrier to passage of the loops from the one of the first and second surfaces. The loop-forming yarn is preferably elastic and tacky.

BRIEF DESCRIPTION OF THE DRAWING

The above and related objects, features and advantages of the present invention will be more fully understood by reference to following detailed description of the presently preferred, albeit illustrative, embodiments of the present invention when taken in conjunction with the accompanying drawing wherein:

FIG. 6 is a view of nesting for the knitting apparatus modified for an additional spandex warp;

FIG. 7 is an end view of a modified bar lever of the invention for assuring exact movement of the additional spandex warp;

FIG. 8 is a partial view of the arrangement of a needle bar, knock-over tongue bar, tongue bar and stitch comb bar, provided in accordance with the present invention;

DETAILED DESCRIPTION OF THE PREFERRED EMBODIMENTS

Figure 1:
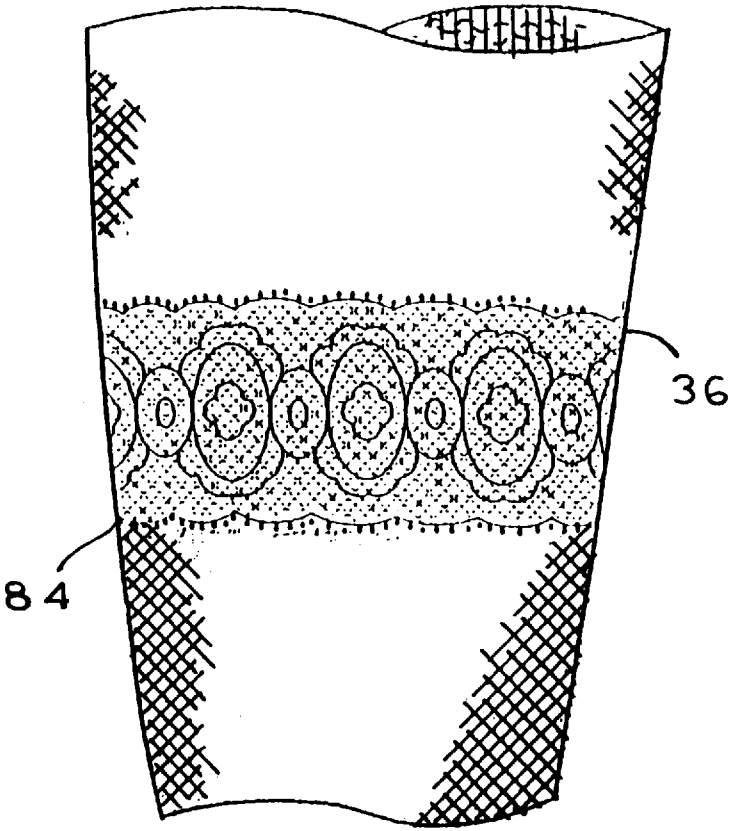
FIG. 1 is a fragmentary side elevational view of a stocking having a lace border and spandex loops, in accordance with the present invention.

Referring now to FIG. 1, therein illustrated is a stocking having a band of knitted lace fabric having spandex loops according to the present invention, generally designated by the reference numeral 1. As best seen in the sectional view of FIG. 2, the knitted lace fabric 1 is formed of opposed first and second surfaces of yarn generally designated 2, 4 and a stretchable tacky layer 3 of spandex loops. The spandex loops are disposed at least partially on one of the first and second surfaces to provide enhanced frictional engagement of the fabric 1 with a surface (such as a leg of a wearer, not shown), adjacent to the tacky layer 3.

As a practical matter, generally the layer 3 of spandex loops is desirable on only one surface of the fabric. For example, in a stocking, it is desirable for the inner surface to be tacky and cling to the thigh, thereby to support the stocking, but it is not desirable for the outer surface to be tacky as it would cause a skirt worn over the stocking to cling thereto and ride up and down. On the other hand, there are situations where it is desirable for a lace fabric to be tacky and exhibit non-slip properties on both surfaces thereof. For example, such a fabric might find utility as a bra strap where one surface of the strap was sufficiently tacky to keep the strap on the wearer's shoulder (so that it did not slide down the shoulder) and the other surface was sufficiently tacky to keep a shoulder strap or a sleeve top over the strap (so that the bra strap did not become exposed).

The invention also relates to modifications to conventional warp-knitting machines so as to provide down-feeding of additional spandex yarn to form tacky, elastic loops in a surface of a lace product. Details of a warp-knitting machine are not specifically shown in the drawings or described in detail herein, since these machines are old and their mechanisms are well known to those of ordinary skill in the art. Generally, such knitting machines include a plurality of guide bars that are reciprocated in relation to a needle bar by individual links of chains that have various depths. After the guide bars are positioned during each course by a link in the chain, the desired stitch is made by actuating the needle bar with a cam.

Figure 3:
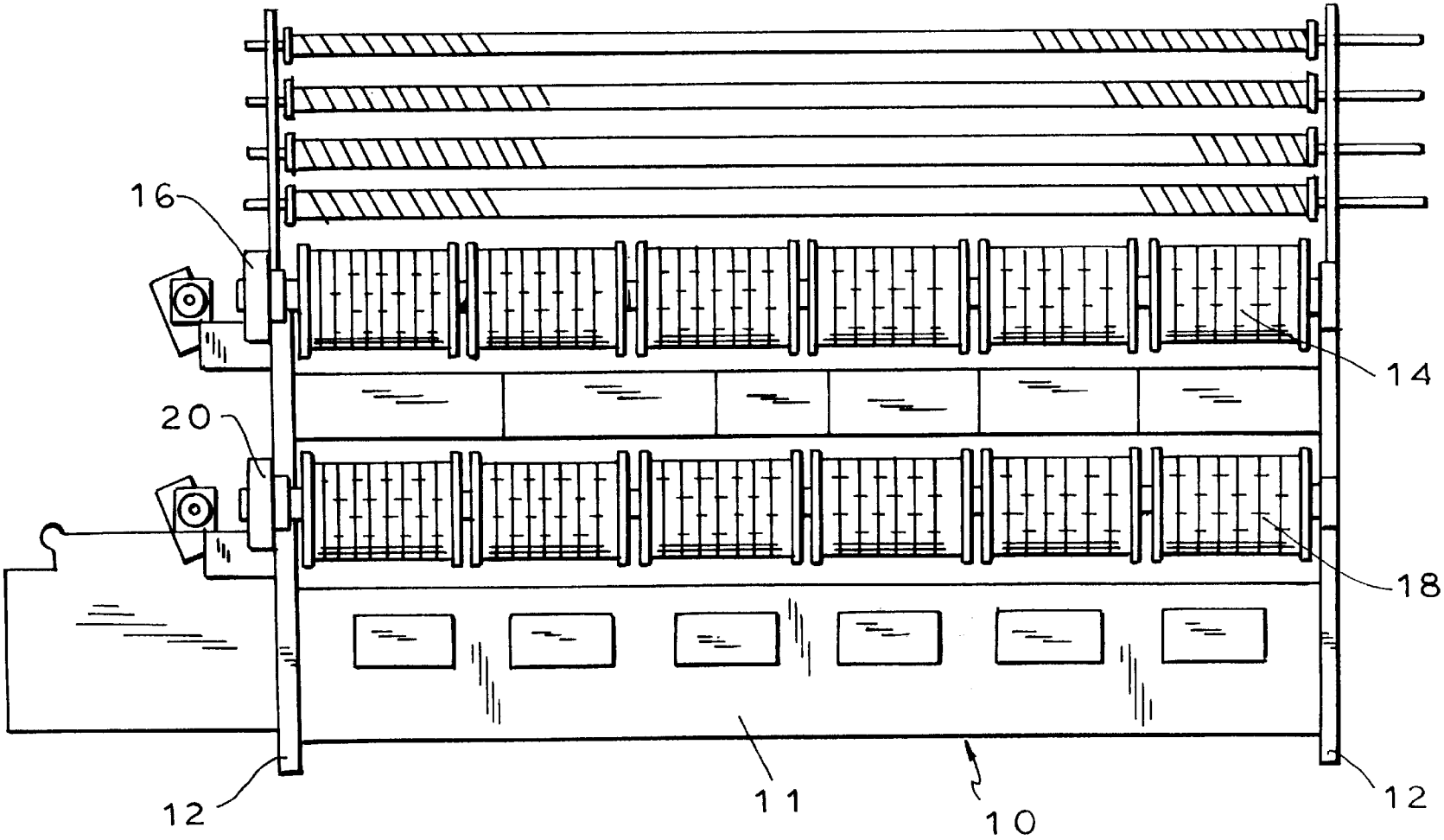
FIG. 3 is a rear elevation of a lace knitting apparatus having dual spandex warps as provided in accordance with the principles of the present invention.
Figure 4:
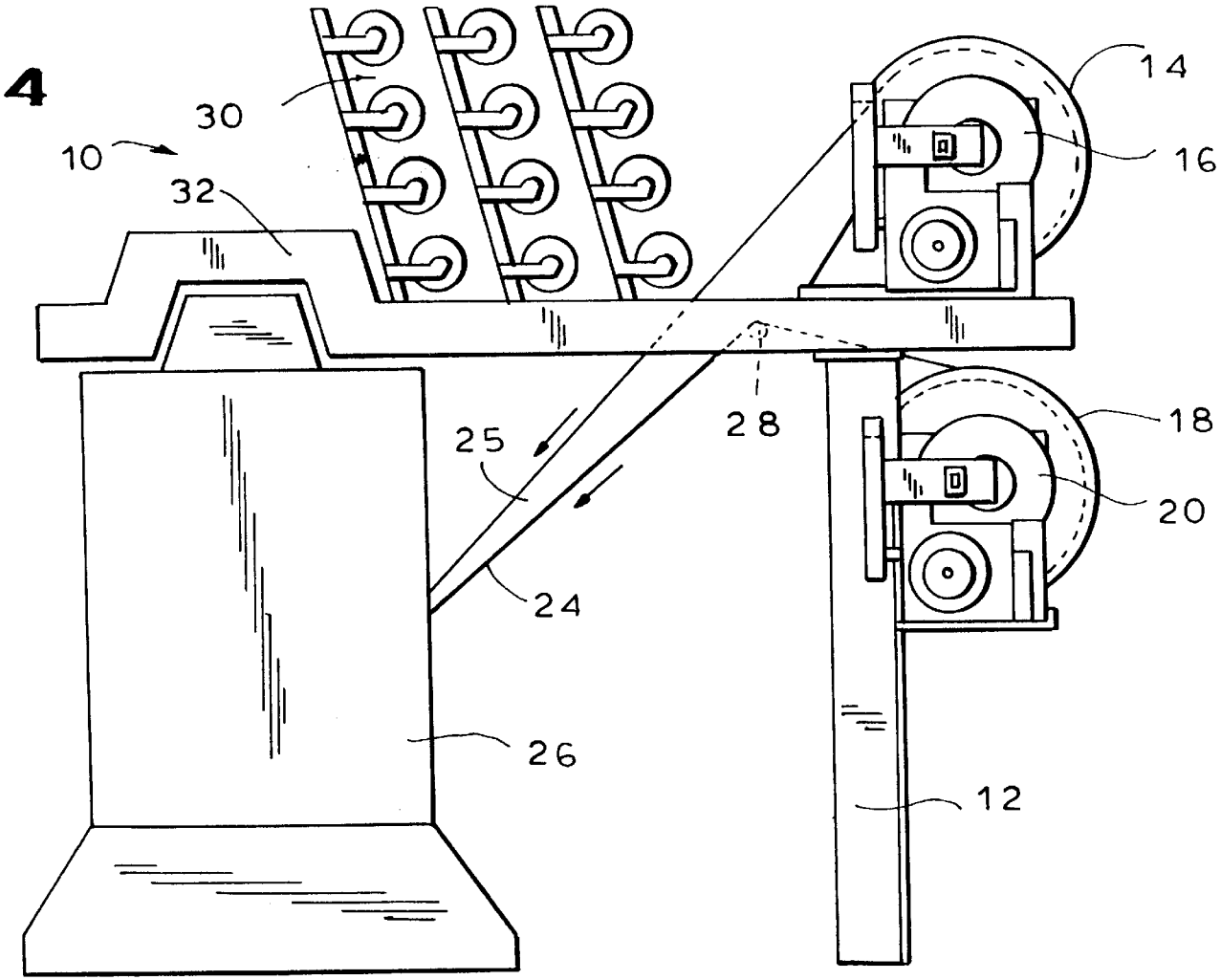
FIG. 4 is a side view of a lace knitting apparatus provided in accordance with the invention showing down-feeding of spandex yarns from dual spandex warps.

Referring to FIGS. 3 and 4, a warp-knitting apparatus 10 is shown which has been modified in accordance with the principles of the present invention. The conventional knitting machine, modified in accordance with the invention, may, for example, be a Raschel or Jacquard lace knitting machine, a Kitty lace knitting machine, Liba lace knitting machines, Comez and other Mayer lace knitting machines.

As shown in FIGS. 3 and 4, the illustrated apparatus 10 includes conventional warp stands 12 disposed at opposite ends of frame 11. The conventional stands 12 support a spandex warp 14 at each end thereof. The spandex warp 14 is used to down-feed spandex yarn 25 to be knitted into a lace product to give it elasticity. A mounting assembly 16 is provided for the warp 14 and includes receiver brackets and bearings permitting rotation of warp 14. In accordance with the invention, the stands 12 have been modified by moving mounting assembly 16 upward, relative to its conventional position. Such rearrangement of the spandex warp 14 permits mounting an additional spandex warp 18, in accordance with the invention, below and parallel to spandex warp 14. The additional or loop-forming spandex warp 18 includes a mounting assembly 20 having receiver brackets, bearings drives and components to electronically or mechanically drive spandex warp 18. Thus, as shown in FIG. 4, the conventional spandex warp 14 is mounted directly above the additional spandex warp 18.

As shown in FIG. 4, each warp 14, 18 feeds spandex yarn 24, 25 into the knitting machine 26 in the direction of the arrows. Additional rollers 28 are provided to ensure the proper down-feeding of the spandex yarn 24 being fed from spandex warp 18. Conventional spot beams, generally indicated at 30, are provided on spot beam support 32. Yarn feed is mechanically or electrically controlled.

Figure 2:
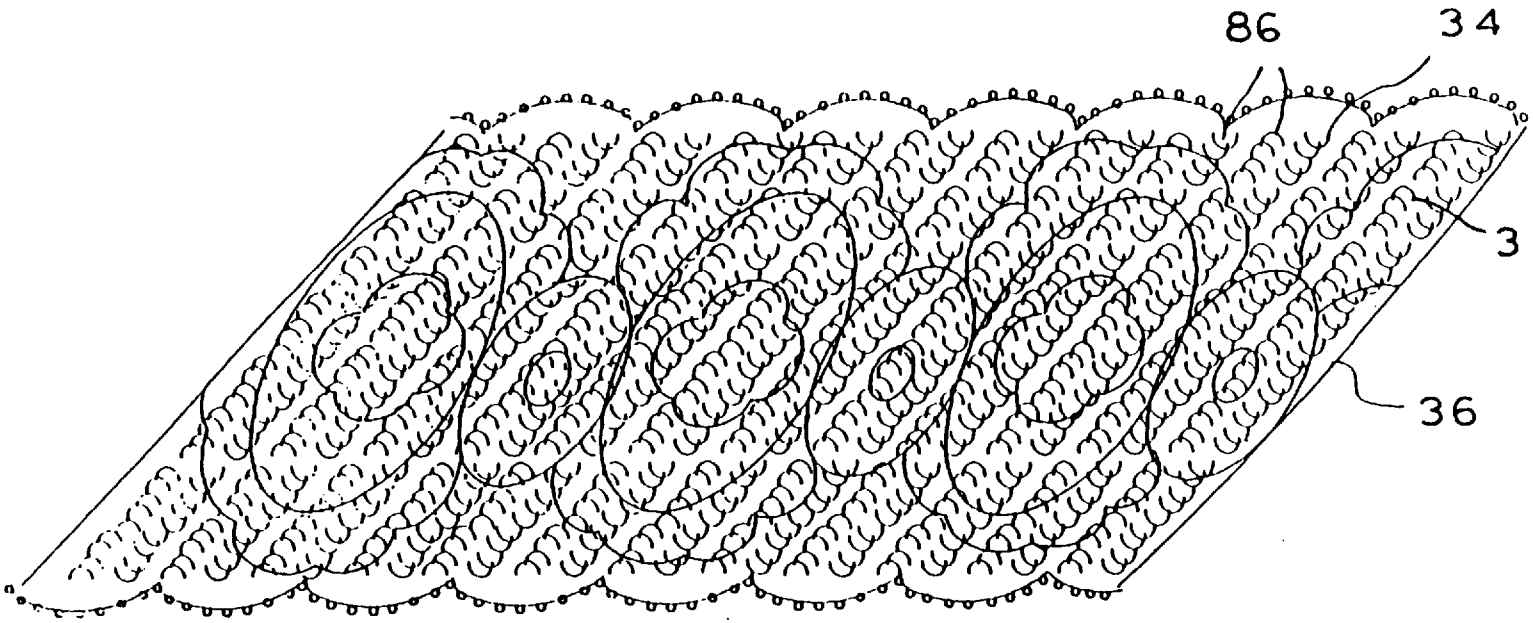
FIG. 2 is a view of an underside of the lace border of FIG. 1 having spandex loops in accordance with the invention.

The feeding speed of the additional or loop-forming spandex warp 18 is synchronized against that of spandex warp 14 so that spandex warp 18 will create spandex loops 34 in the lace product 36, as shown in FIG. 2. The loops 34 are provided on one side of the lace product 36, preferably in rows of alternating direction, as will become more apparent below.

Figure 5:
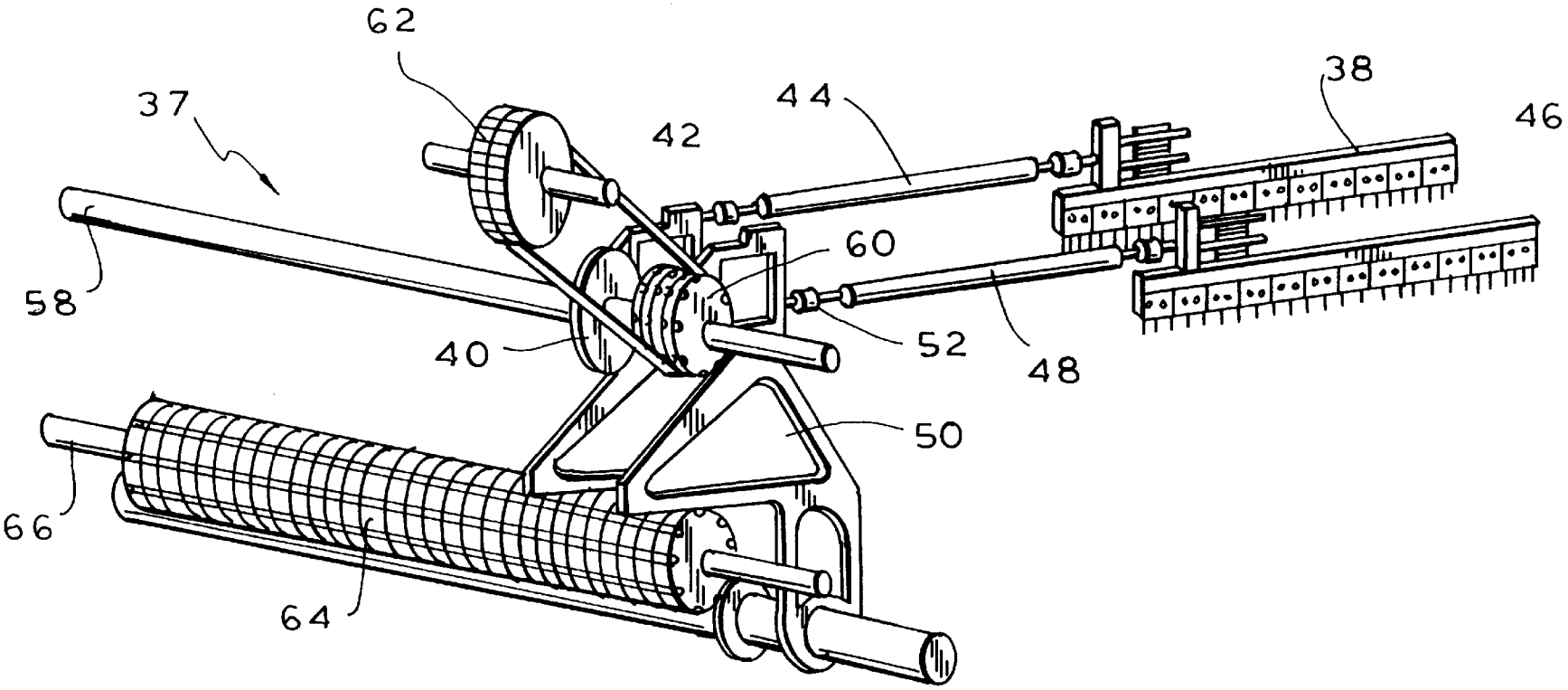
FIG. 5 is a partial perspective view of a pattern drive mechanism of the lace knitting apparatus of the invention for controlling spandex loops through an additional spandex warp.

The pattern drive mechanism 37 of the knitting apparatus 10, as provided in accordance with the present invention, is shown in FIG. 5. Spandex yarns 25 (FIG. 4) of spandex warp 14 are down-fed into a conventional spandex ground guide bar 38 (FIG. 5). The ground bar 38 is actuated and driven by a pattern cam 40 acting on bar lever 42. Bar lever 42 is coupled to rod 44 which in turn is coupled to ground bar 38.

Figure 9:
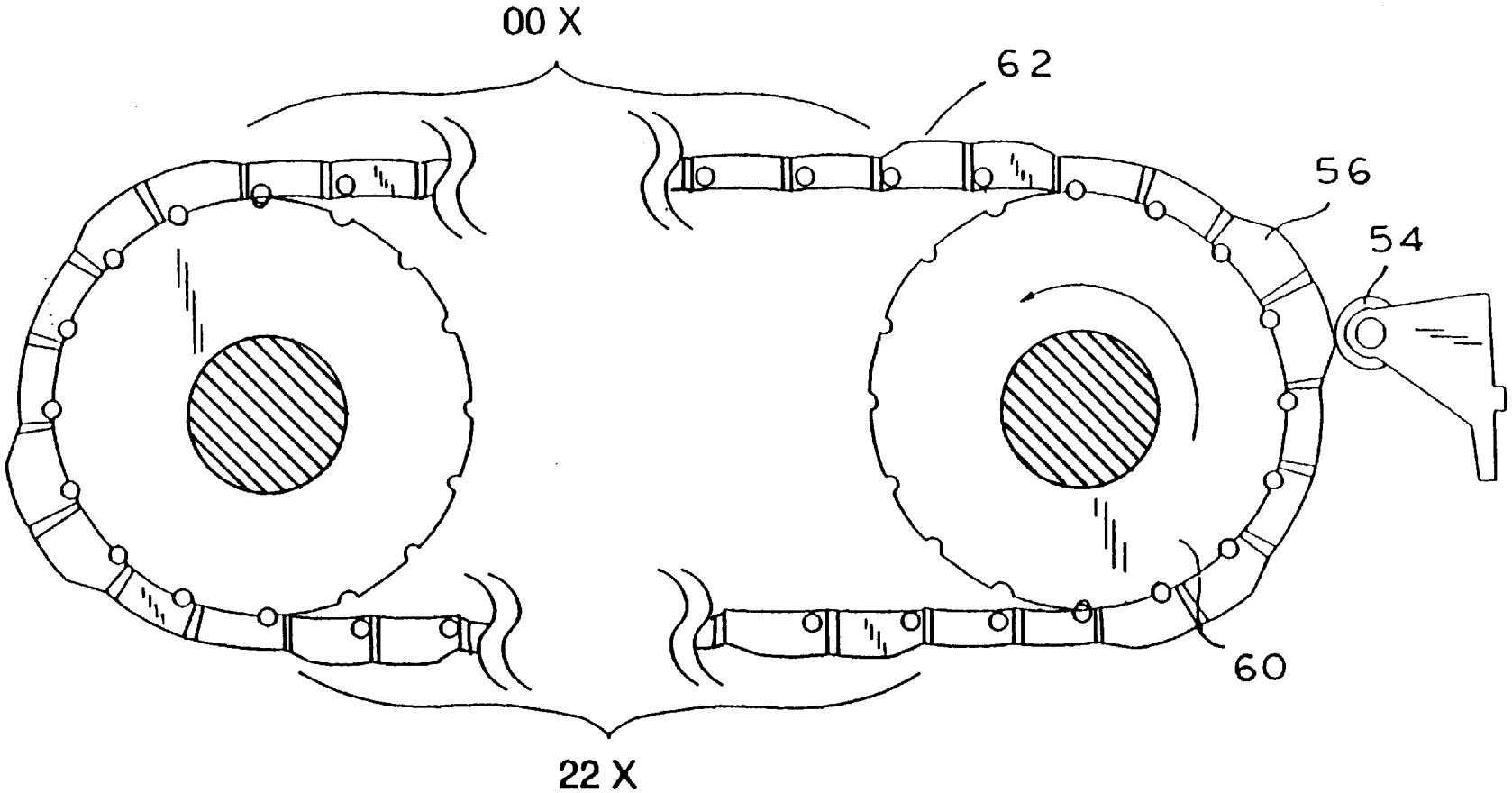
FIG. 9 is a schematic view of loop formation pattern chain control provided in accordance with the principles of the present invention.

To take-up the loop-forming spandex yarn 24 (FIG. 4) fed from the additional warp 18, an additional ground bar 46 (FIG. 5) is provided. Ground bar 46 is coupled to rod 48 which is coupled to bar lever 50 at contact screw 52. As shown in FIG. 7, bar lever 50 has been modified by moving the location of the contact screw down approximately 135 millimeters from a conventional position, shown by dashed lines. This modification ensures proper gaiting of cam 54 of bar lever 50 against pattern chain links 56 (FIG. 9).

FIG. 5 shows the remaining elements of the pattern drive mechanism 37 which are of conventional design and will be only generally described below. Thus, a main upper pattern drive shaft 58, a pattern drum 60, a pattern chain 62, a main bottom chain drum 64 and a main bottom drive shaft 66 are provided. The pattern drive mechanism 37 guides and limits the lateral movement of the guide bars.

Loop control nesting, as provided in accordance with the present invention, is shown in FIG. 6. In the illustrated embodiment, three front guide bars 68, eight pattern guide bar nestings 70, ground guide bar 72 for warp 14 and ground guide bar 74 for the newly added warp 18 are provided.

FIG. 8 shows the relationship of the needle bar 76, knock-over comb bar 78, tongue bar 80 and stitch comb bar 82, provided in accordance with the present invention. The illustrated nesting requires an adjustment of the needle bar cams, since the upcoming needle bar 82 must enter the new guide bar 74 at the proper position to tie down a loop in the back of a lace fabric, as will become apparent below. Thus, the needle bar cam is adjusted by retarding it approximately 7 degrees.

With reference to FIG. 9, the spandex loops 34 (FIG. 2) are produced by computed movement of the additional or loop-forming spandex warp 18 by pattern chain 62 control, by moving 00 even link 12 times, to form loop 34 with the stitch direction to the right. Next, the loop 34 is tied down by moves 44/00/22 and then the stitch is worked by reversing the loop 34 to the left by movements 22/00/44×12. The loop is then tied down by movements of 44/00/22. Twenty-five inches of spandex yarn are fed per 480 courses from the additional spandex warp 18 to form loops 34 (see FIG. 12) while ten inches of spandex yarn 168 (see FIG. 12) are fed per 480 courses from spandex warp 14 to form the inner spandex layer 156 (see FIG. 12). This sequence is then repeated. Of course, the above sequence may be altered depending upon pattern repeat and loop requirement. The preferred formation of the loop to the right in one sequence of 12 stitches and to the left in the next sequence of 12 stitches by use of the additional spandex warp 18 results in a non-directional fabric, which simplifies mating the fabric to a stocking or other garment.

The alternating loop 34 formation is shown in FIG. 2. As shown, rows 86 of alternating loops 34 are defined on only one surface 24 of the lace fabric 36 so that one row generally extends toward one edge of the fabric, while the other generally extends toward the diametrically opposite edge of the fabric. The length of the spandex loop 34 is controlled by the inherent elongation of the spandex yarn, the given feed, and the tying down by lateral movement of the set bar and stitches applied while floating. Preferably, the spandex yarn used is of heavy denier and of a clear variety to maintain clarity in the fabric and, thus, not be seen through the finished product. If a clear spandex yarn is not desired, the spandex may be dyed to match the color of the finished, knitted product. Further, since the loops are placed in the back or rear surface of the fabric, the fabric retains clarity on the face, which enhances the finished lace product.

It has been discovered that when a fabric, having loops on one surface thereof as provided herein-above, is repeatedly worn and washed, some of the loops may come through to the other surface of the fabric and may cause a reduction in the non-slip property. To resolve this potential problem, the lace netting itself may be knitted, in accordance with a further feature of the invention, to substantially prevent the loops from passing through to the other surface. More particularly, in accordance with a further feature of the invention, the lace is knitted so that the second ground bar yarn 162 (see FIG. 12) is tied down after every stitch. This precludes passage of loops through the lace material. Further, so forming the lace netting 154 (see FIG. 12) makes the lace a material which does not unravel or run.

The netting 90 is created as follows, with reference to FIG. 6. Guide bar 68*a*, which is the main stitching bar, knits a regular 20/02 pillar stitch 164 (see FIG. 12) with lacers added to the bar for band separation. Guide bar 68*b* is threaded full and works under the pillar stitch bar 68*a* to form a net construction 162 (see FIG. 12) of 20/02/20/42/24/42. It is preferable that a fine yarn such as 30 denier be used for the netting. Thus, the double stitch creates a dense net and locks down the pillar stitch of bar 68*a* to create a non-run, non-tacky net and also prevents the spandex loops from protruding from the surface of the fabric opposite to the surface in which the loops were formed.

As shown in FIG. 1, the lace fabric 36 having the tacky, elastic loops 34 on one side thereof may be employed as a stocking border 84. The loops are defined on the inside of the lace border 84 so as to create a clinging effect with the wearer's skin due to increased friction therewith, to maintain the stocking in place on the leg. It can be appreciated that the loops can be formed on foundation fabrics to prevent what is commonly called "riding-up" of slips, or other liner components by creating a clinging effect with skin or other garments. Thus, it can be appreciated that fabric of the invention may be incorporated into a garment so that the loops face in or so that the loops face out, depending where frictional engagement is desired. Loops are formed on the inside surface of a stocking border to increase friction with the wearer's skin, while loops may be placed on the outside surface of foundation fabrics or slips to increase friction with another garment to prevent "riding-up".

Thus, the present invention provides a product that is functional in holding and clinging against the skin or other garments to prevent movement of the garment, while maintaining wearer comfort, and which most preferably is a non-run lace product. When the loops are formed on a stocking border, they prevent slippage of the stocking without restricting circulation in the leg. Since the loops are integral with lace fabric, washability and durability of the fabric are not diminished.

The clingability of the fabric is determined by 35 its tackiness and elasticity (compressiveness). While the present invention as described above provides a product that is at least initially functional in holding and clinging against the skin or other garment to prevent relative movement of the product, while maintaining wearer comfort, the functionality of the product is short-lived. After about two hours of wear with the layer 3 of spandex loops 34 adjacent to the wearer's skin, the loops lose their tackiness and hence their functionality in holding and clinging against the skin. This loss of functionality increases progressively over time of wear until, after about four hours of wear, the progressive loss of functionality reaches a point where there is such extreme slippage that the stocking will typically no longer stay up by itself. The times indicated are intended to provide a general frame of reference only, and it will be appreciated that the actual times will depend upon the particular wearer's body (for example, to what extent his/her body gives off moisture and body oil in the skin area adjacent to the fabric), where the fabric is located on the wearer, the forces tending to move the fabric relative to the skin, the tightness with which the loops are pressed against the skin, etc. Inasmuch as stockings and many other garments are intended to be worn for a full eight hour day, the present invention as described above does not represent a full solution to the problem. However it has now been found that, in a preferred embodiment of the present invention, the full solution is achievable by creation on the spandex loops 34 of a stretchable, tacky coating of cured and foamed, oleophobic and hydrophobic plastisol 20.

By way of background, a plastisol is a dispersion of fine particle-size resin and a plasticizer. Preferably, although not necessarily, the resin useful in the present invention is a polyvinyl chloride (PVC) homopolymer or copolymer resin. The plastisol is a dispersion of the fine particle size resin (0.1–2 micron range) and talc-like in quality (i.e., not grainy). The plastisol resins are polymerized in latex form, with the vinyl chloride polymer dispersed as droplets in the water phase so that some of the monomer dissolves in the water. Other processes may also be used. Once a latex of polymer particles is formed, the resin is separated from the water phase and ground to reduce any resin clusters.

The curing and foaming of liquid plastisol with a chemical blowing agent is well known in the art. Typically the blowing agent is dispersed in the liquid plastisol with a plasticizer at room temperature. As the plastisol is heated to 130° F., it undergoes pre-gellation where the resin particles become swollen with the absorbed plasticizer. The blowing agent is still inert at this temperature. At 180° F., the plastisol is gelled with the swollen parts almost touching and all plasticizer taken up by the resin. At this temperature, the blowing agent is still inert. At 280° F., the plastisol undergoes partial fusion, the plasticizer beginning to dissolve the polymer. There is slight decomposition of the blowing agent and some swelling in size of the plastisol. At 320° F., there is fusion of the plastisol, with the plasticizer becoming uniformly distributed along the polymer chain. The blowing agent continues to decompose, forming nitrogen and carbon dioxide gasses. The gas thus produced begins to swell the plastisol composition. Because the resin is developing strength, the gasses cannot escape therefrom and the material swells—that is, foams. This swelling or foaming continues to develop as more gas is generated (depending upon the type of blowing agent used). The resin dries and cures during the 60–70 seconds it is maintained at 320° F. Care must be taken not to overheat the plastisol as otherwise the resin will "melt" and permit escape of the gas therefrom with a resultant collapse of the foam.

A preferred plastisol for use in the present invention has high stretchability when cured and is available under the trade name SPAND-E-SOL from Rutland Plastic Technologies, Inc. of Pineville, N.C.

Figure 10:
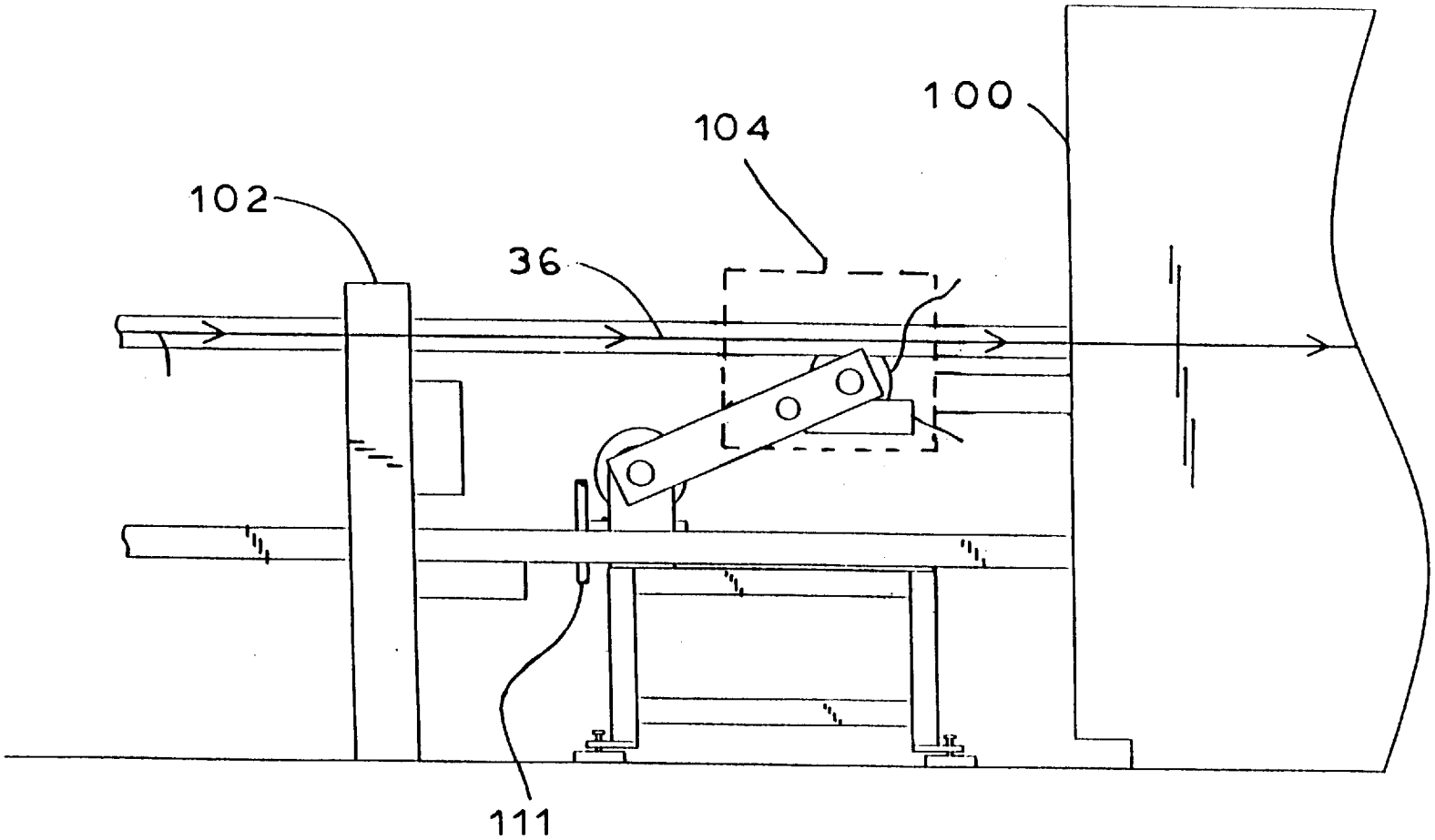
FIG. 10 is a fragmentary schematic side elevational view of a transfer-coater assembly.
Figure 11:
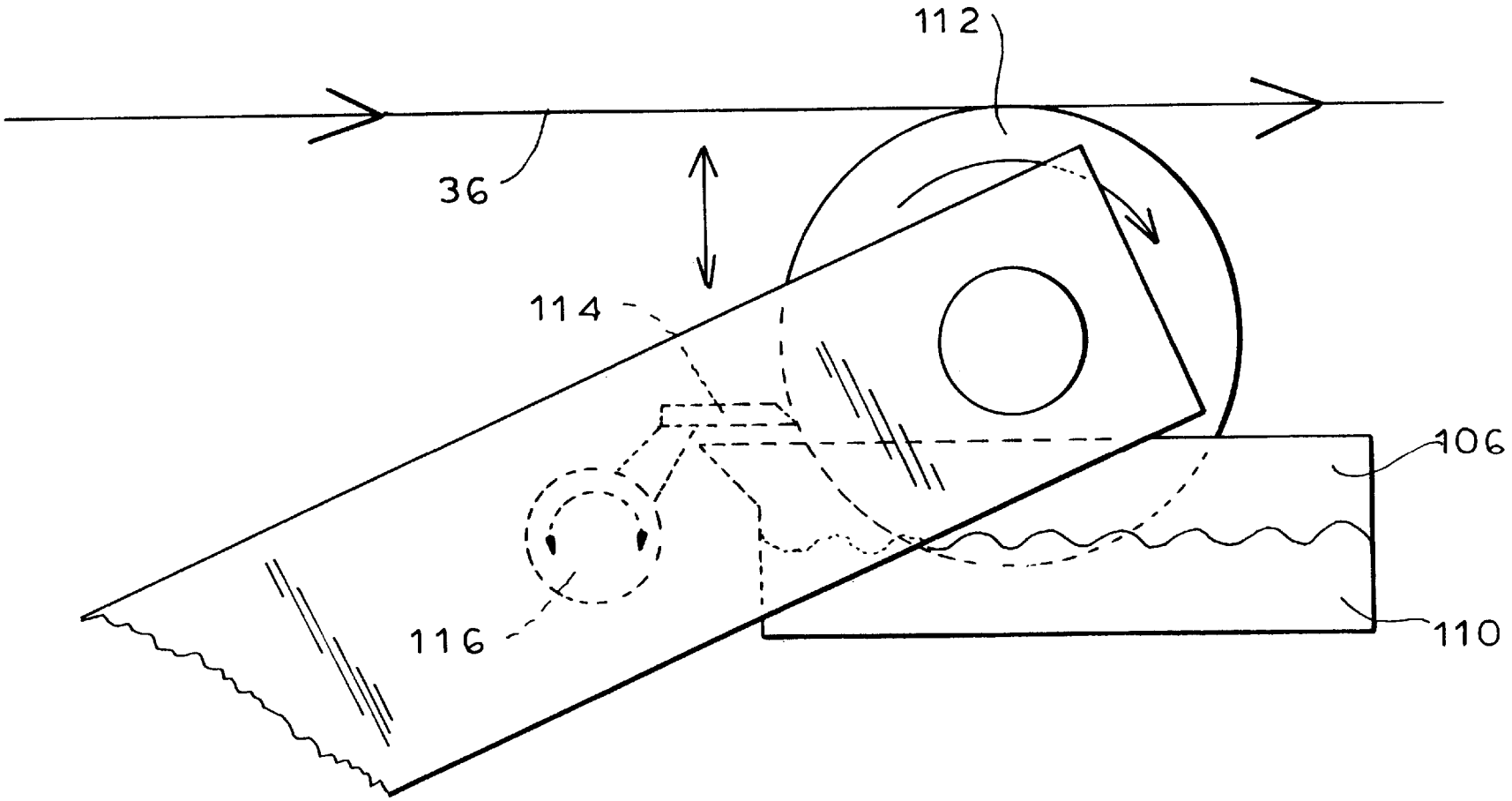
FIG. 11 is a fragmentary schematic side elevational view of the transfer-coater assembly of FIG. 10, to an enlarged scale.

Referring now to FIGS. 10 and 11, in the preferred embodiment of the present invention, after the conventional scouring step to remove processing oils and the like from the knitted lace fabric 36, and before the fabric enters the tenter frame box 100, the fabric receives a plastisol coating. More particularly, the fabric 36 is carried by the tenter frame pins (not shown), with the loops positioned down, through a guide pin adjustment 102 (which enables accommodation of different fabric widths), and into a transfer assembly 104. Within the transfer assembly 104 is a reservoir 106 containing the uncured and unfoamed liquid plastisol 110 to be transferred to the fabric, and a transfer roll 112 which rotates in the direction of fabric travel. The transfer roll 112 at the bottom extends into the liquid plastisol 110 in the reservoir 106 and at the top contacts the depending loops 34 of the fabric 36.

In order to enable control of the amount of liquid plastisol 110 being applied to the fabric 36 by the transfer roll 112, a doctoring or scraping blade 114 is adjustably mounted at 116 in the transfer assembly next to the transfer roll 112 so as to scrape off and remove any excess of the plastisol from the transfer roll and allow the excess to return to the reservoir 106. The entire transfer assembly 104 is separately mounted from the fabric path so as to enable an adjustment at 111 of the degree of contact between the top of the transfer roll 112 and the bottom of the fabric 36 (i.e., the loops 34). Preferably the transfer assembly 104 effects a transfer of at least one ounce, and preferably 4 ounces, of the plastisol per square meter of the fabric; thereby to effect a plastisol thickness of 1 to 4 mils, and preferably 2 mils, on the loops. The goal is to apply the plastisol as a coating on the loop 34 and in the open spaces of the loops 34, but not on the adjacent inner spandex layer 156 (see FIG. 12).

Once the depending spandex loops 34 of the fabric 36 receive the liquid plastisol coating 110, the fabric 36 is transported from the transfer assembly 104 into the tenter frame box 100 by the tenter frame pins (not shown). The tenter frame box is maintained at 320° F, and the fabric passed therethrough at a rate slow enough to allow drying, foaming and curing of the plastisol in order to produce a foamed and cured plastisol 140. While the optimum time for passage of the fabric through the tenter frame box 100 and the optimum temperature for the tenter frame box 100 will vary with the type of plastisol, the thickness of the plastisol coating deposited on the loops, etc., SPAND-ESOL generally dries, foams and cures in about 70 seconds at 320° F.

When a stretchable, tacky layer of cured and foamed, oleophobic (oil-resistant) and hydrophobic (water-resistant) plastisol is disposed at least partially on the loop surface, it provides for enhanced frictional engagement of the fabric with a surface adjacent to the tacky layer over an eight or more hour period of wear for a stocking. It is believed this is because the plastisol does not absorb the water and body oils emitted by the skin surface and thus retains its stretchable and tacky nature, these being the qualities which provide its desired functionality. To whatever extent the water and body oils are eventually retained on the surface of the plastisol during a wearing, they are easily removed therefrom by conventional washing and drying so that the fabric is again able to provide functionality for another wear period of eight or more hours.

Unlike silicone, the plastisol can be pigmented (prior to being foamed and cured) so that it is undetectable on the underside of the lace material when viewed therethrough. Further, the plastisol, even when cured and foamed, has substantial elastic properties and thus can stretch substantially completely with the lace product. Thus there is no tendency for the plastisol to separate and/or crumble from the lace with repeated stretching. The plastisol further resists crumbling and detachment from the fabric, even during washing, when it extends through at least some of the loops as the loops hold the plastisol to the remainder of the fabric.

While it is clearly preferred that the stretchable, tacky layer of plastisol extend through at least some of the loops, it is not necessary for the plastisol to entirely cover the loops, or any predetermined fraction thereof, as the loops themselves are preferably elastic and/or tacky and thus contribute to the functionality of the fabric in the same manner as the plastisol does (albeit for a shorter wear period). Typically the plastisol will not only extend through the loops, but also will encapsulate a portion of the loops through which it extends. The presence of the plastisol on a loop, even when it does not entirely cover or encapsulate the loop, acts to space the loop away from the skin of the wearer, thereby protecting the loop from moisture and body oil from the skin surface.

Figure 12:
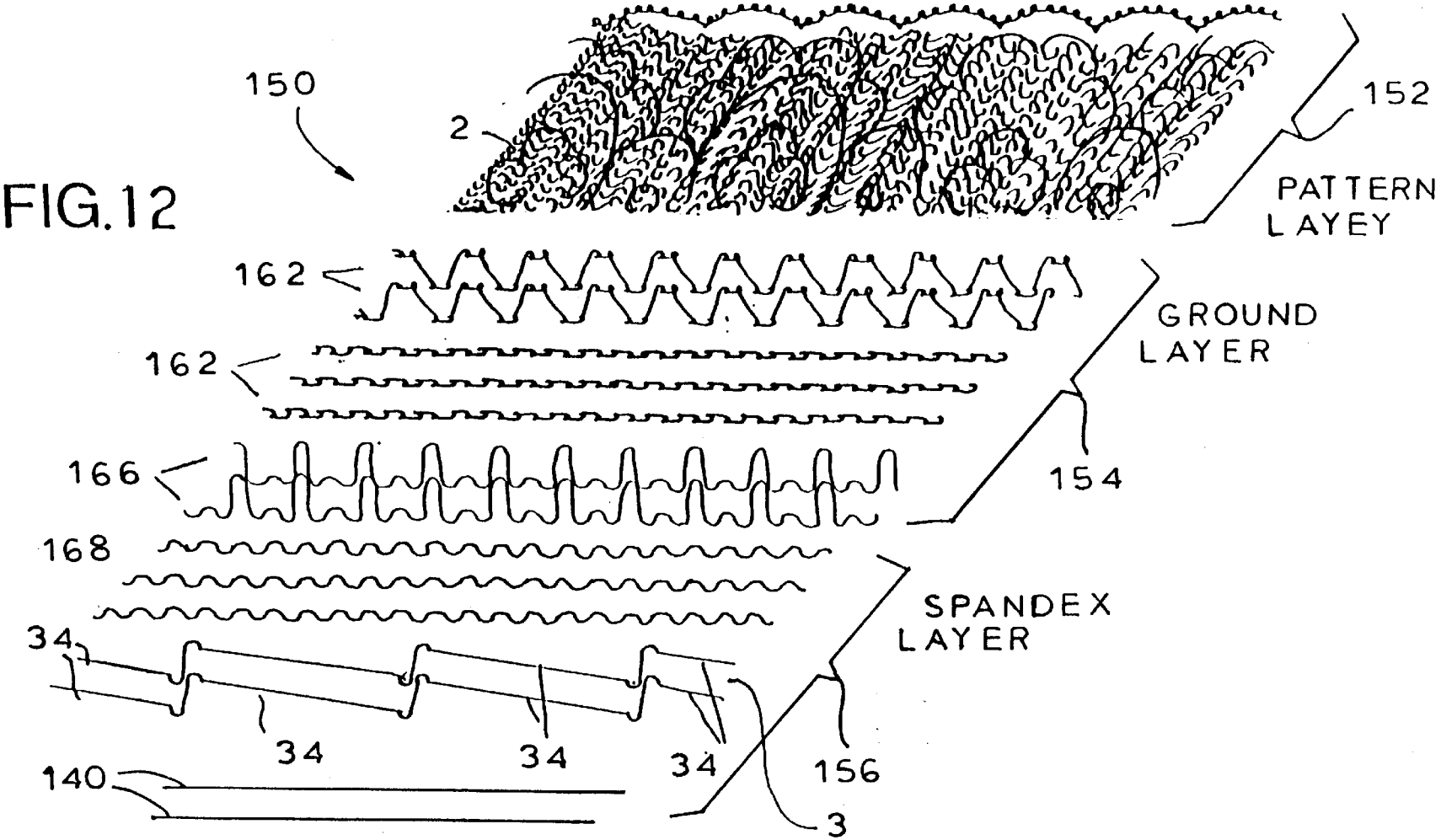
FIG. 12 is a schematic exploded view of the preferred embodiment of the present invention, in the form of a lace cutting with yarn layers and its actual stitch formation.

Referring now to FIG. 12, therein illustrated for expository purposes as a series of layers is an exploded schematic view of the product (such as a stocking top) formed by the preferred embodiment 150 of the present invention The preferred embodiment consists of the pattern layer 152 on top (which forms the outer surface of the stocking and gives it the lace-like appearance), the ground layer 154 (which serves as the intermediate layer of yarn knitted therein as a net), the inner spandex layer 156 (which provides stretch control), and the spandex loops 34 containing the plastisol 140 (which gives the non-slip feature). More particularly, the pattern layer defines one of the first or second surfaces 2, 4; the ground layer 154 includes the ground stitch 162, the pillar chain stitch 164, and the ground inlay 166; the inner spandex layer 156 includes the spandex lay-in 168; and the spandex loops 34 with the plastisol 140 encapsulating at least a portion of the spandex loops 34 form the other surface 2, 4 of the lace fabric. It will be appreciated that the spandex loops 34 and the plastisol 140 do not necessarily form a continuous layer.

Figure 13:
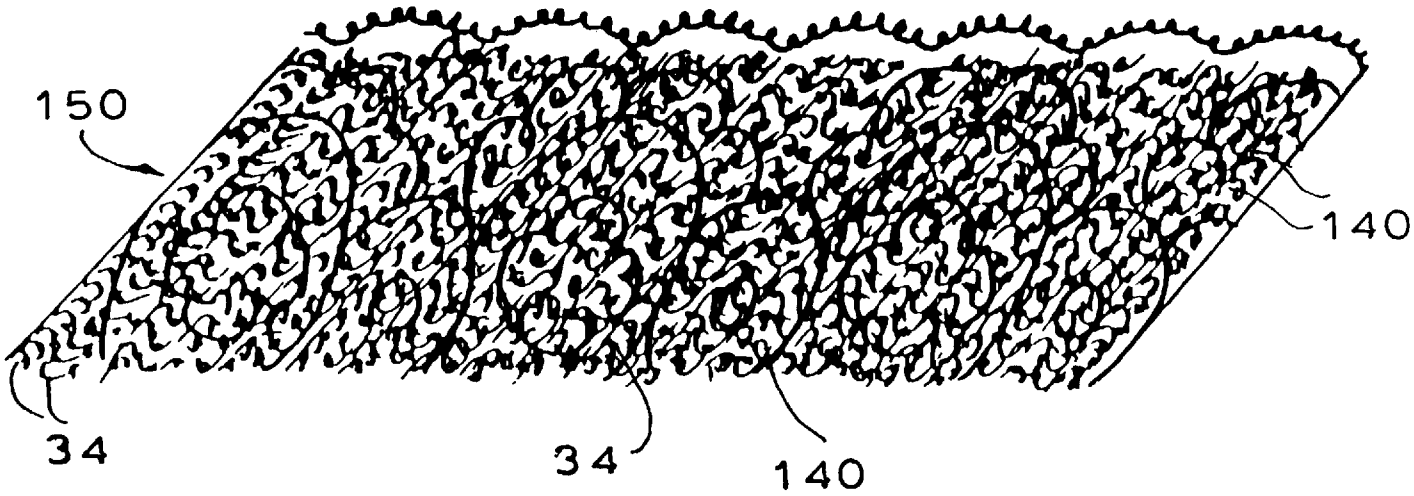
FIG. 13 is a view similar to FIG. 2, but of the preferred embodiment using plastisol.

Referring now to FIG. 13, in the preferred embodiment 150, the globs of foamed and cured plastisol 140 can be readily discerned passing through the open portion of the spandex loops 34.

While the present invention has been described primarily in the context of a stocking, and in particular a thigh-high stocking where the function of the fabric of the present invention is to provide an attractive and comfortable lace border which will hold up the top of the stocking, the present invention has utility in a number of different applications. For example, in order to make a girdle more attractive and prevent the legs thereof from "riding-up", the bottom of the legs may be made of the fabric. The fabric will provide a desirable lace-like outer surface, while the inner surface of the fabric will cling to skin and resist ride-up.

To summarize, in a preferred embodiment the present invention provides a knitted lace fabric which is characterized by a high level of non-slip property —that is, a non-slip fabric. The non-slip property does not substantially fade away during the time the fabric is being worn, and the fabric resembles ordinary knitted lace fabric not having the non-slip property. Also provided is a method for manufacturing such a non-slip knitted lace fabric, Now that the preferred embodiments of the present invention have been shown and described, various modifications and improvements thereon will become readily apparent to those skilled in the art. Accordingly, the spirit and scope of the present invention is to be construed broadly and limited only by the appended claims, and not by the foregoing specification.

I claim:

1. A non-slip knitted lace fabric having opposed first and second surfaces of yarn and a stretchable tacky layer of in situ cured and foamed, oleophobic and hydrophobic plastisol disposed at least partially on one of said first and second surfaces to provide enhanced frictional engagement of the fabric with a surface adjacent to said tacky layer.

2. A non-slip knitted lace fabric having opposed first and second surfaces of yarn and a stretchable tacky layer of in situ cured and foamed, oleophobic and hydrophobic plastisol disposed at least partially on one of said first and second surfaces to provide enhanced frictional engagement of the fabric with a surface adjacent surfaces to provide enhanced frictional engagement of the fabric with a surface adjacent to said tacky layer, said fabric having a loop-forming yarn knitted therein so as to provide a plurality of loops thereof as said one of said first and second surfaces, said tacky layer extending through openings of at least some of said loops.

3. The fabric of claim 2 wherein said loop-forming yarn is elastic.

4. The fabric of claim 2 wherein said loop-forming yarn is tacky.

5. The fabric of claim 2 wherein said loop-forming yarn is elastic and tacky.

6. The fabric of claim 2 wherein said fabric has an intermediate layer of yarn knitted therein as a net, intermediate said first and second surfaces, so as to provide a barrier to passage of said loops from said one of said first and second surfaces to the other of said first and second surfaces.

7. The fabric of claim 6 wherein said net is non-tacky.

8. A non-slip knitted lace fabric having opposed first and second surfaces of yarn, a loop-forming yarn of elastic and tacky properties knitted therein so as to provide a plurality of loops thereof as said one of said first and second surfaces, and a stretchable tacky layer of cured and foamed, oleophobic and hydrophobic plastisol disposed at least partially on said one of said first and second surfaces to provide enhanced frictional engagement of the fabric with a surface adjacent to said tacky layer, said tacky layer extending through at least some of said loops.

9. A method of making a non-slip knitted lace fabric comprising the steps of:

(A) providing a knitted lace fabric having opposed first and second surfaces of yarn;

(B) applying uncured and unfoamed plastisol at least partially on one of said first and second surfaces; and (C) curing and foaming the layer of plastisol to provide a stretchable tacky layer of oleophobic and hydrophobic plastisol affording enhanced frictional engagement of the fabric with a surface adjacent to the tacky layer.

10. A method of making a non-slip knitted lace fabric comprising the steps of:

(A) providing a knitted lace fabric having opposed first and second surfaces of yarn, the fabric having a loop-forming yarn knitted therein so as to provide a plurality of loops thereof as the one of the first and second surfaces;

(B) applying a layer of uncured and unfoamed plastisol at least partially on one of said first and second surfaces, the layer of plastisol being applied so as to extend through openings of at least some of the loops; and (C) curing and foaming the layer of plastisol to provide a stretchable tacky layer of oleophobic and hydrophobic plastisol affording enhanced frictional engagement of the fabric with a surface adjacent to the tacky layer.

11. The method of claim 10 wherein the loop-forming yarn is elastic and tacky.

12. The method of claim 10 wherein the fabric has an intermediate layer of yarn knitted therein as a net, intermediate the first and second surfaces, so as to provide a barrier to passage of the loops from the one of the first and second surfaces to the other of the first and second surfaces.

13. The method of claim 12 wherein the loop-forming yarn is elastic and tacky.

14. A method of making a non-slip knitted lace fabric comprising the steps of:

(A) providing a knitted lace fabric having opposed first and second surfaces of yarn and including a loop-forming yarn knitted therein so as to provide a plurality of loops thereof as one of the first and second surfaces, the fabric having an intermediate layer of yarn knitted therein as a net, intermediate the first and second surfaces, so as to provide a barrier to passage of the loops from the one of the first and second surfaces to the other of the first and second surfaces;

(B) applying uncured and unfoamed plastisol at least partially on the one of the first and second surfaces so as to extend through openings of at least some of the loops; and (C) curing and foaming the layer of plastisol to provide a stretchable tacky layer of oleophobic and hydrophobic plastisol affording enhanced frictional engagement of the fabric with a surface adjacent to the tacky layer.

* * * * *